US005414100A

United States Patent [19]

Ayorinde et al.

[11] Patent Number: 5,414,100

[45] Date of Patent: May 9, 1995

[54] DEACIDIFICATION OF VEGETABLE OILS

[75] Inventors: Folahan O. Ayorinde, Kettering; Mahmoud Hassan, Silver Spring, both of Md.

[73] Assignee: Howard University, Washington, D.C.

[21] Appl. No.: 112,915

[22] Filed: Aug. 27, 1993

[51] Int. Cl.[6] ..... C11B 3/10

[52] U.S. Cl. ..... 554/191; 554/193; 554/194; 502/25

[58] Field of Search ..... 554/191, 193, 194; 502/25

[56] References Cited

PUBLICATIONS

Simone, C., *Oil Mill Gazetteer,* 98(2):26–31 (1992).
Braae. B., *J. Am. Oil Chem. Soc.* 53:353–357 (1976).
Carr, R. A., *J. Am. Oil Chem. Soc.* 53:347–352 (1976).
Cowan, J. C., *J. Am. Oil Chem. Soc.* 53:344–346 (1976).
Sullivan, F. E., *J. Am. Oil Chem. Soc.* 53:358–360 (1976).
Carlson, K. F. and Scott, J. D., *Inform* 2:1034–1060 (1991).
Cho, S. Y., Kwon, T. W. and Yoon, S. H., *J. Am. Oil Chem. Soc.* 67:558–560 (1990).
Gloyer, S. W., *J. Am. Oil Chem. Soc.* 26:162–166 (1949).
Yalley, E. S., F. O. Ayorinde, and B. E. Eribo, *J. Am. Oil Chem. Soc.* 69(10) 1–3 (1992).
Dirlikov, S., S. Islam, I. Frischinger, T. Lepkowski and P. Muturi, *Industrial Finishing,* 68(2):17–19 (1992).
Carlson, K. D., W. J. Schneider, S. P. Chang and L. H. Princen, in *New Sources of Fats and Oils,* edited by E. H. Pryde, L. H. Princen and K. D. Mukherjee, American Oil Chemists's Society, Champaign, Ill., 1981, pp. 297–314.
USDA Cooperative State Research Service, *Growing Industrial Materials: Lesquerella as a Source of Hydroxy Fatty Acids for Industrial Products,* Oct., 1991.

*Primary Examiner*—José G. Dees
*Assistant Examiner*—Deborah D. Carr
*Attorney, Agent, or Firm*—Kenyon & Kenyon

[57] ABSTRACT

A chromatographic process for deacidification of vegetable oils at ambient temperature. According to the process, which can be retrofitted into deacidification operations using miscella refining or solvent extraction, crude vegetable oil is dissolved in a solvent such as isopropyl alcohol and passed through a column of activated alumina (aluminum oxide) at room temperature. The process, which eliminates physical contact between both oil and an alkaline reagent and oil and water, simplifies subsequent bleaching processes by also removing some color pigments. The spent alumina can be reactivated by washing it with a dilute solution of sodium hydroxide or potassium hydroxide.

17 Claims, No Drawings

DEACIDIFICATION OF VEGETABLE OILS

FIELD OF THE INVENTION

This invention is concerned with a process in which vegetable oils are deacidified by passing solutions of the oils in rubbing alcohol (2-propanol) through a column of activated alumina (aluminum oxide). Additionally, a process was developed by which the "used" alumina can be reactivated for subsequent use.

BACKGROUND OF THE INVENTION

Traditionally, production of crude vegetable oils has been accomplished by mechanical pressing or solvent extraction, and, in some cases, by a combination of both, especially for seeds with high oil content. )On the average, most crude oils consist of over 95% triglyceride molecules, while minor components are present in the form of free fatty acids (FFA), phospholipids (gums), color pigments, moisture and proteinaceous materials. Thus in order to obtain vegetable oils with acceptable industrial and/or edible quality, the crude oil is often subjected to a series of processes designed to remove the various impurities. Such processes include: degumming, refining (deacidification), bleaching, winterization and deodorization.

Of the various refining processes, removal of FFA (deacidification) is deemed most critical due to the fact that high level (>0.5%) of FFA could reduce the shelf-life of the oil by promoting rancidity, moreover, downstream processing is adversely impacted by free fatty acids impurity. Over the years, the most industrially accepted deacidification method is caustic (alkaline) refining, a process during which the crude oil is treated with dilute solution of sodium hydroxide. In a typical alkaline refining process, the oil is passed into a tank and then thoroughly mixed with sodium hydroxide solution (concentration depends on the level of FFA in the crude oil) at 70° C. to 80° C. for about 1–15 minutes. The resulting slurry is then centrifuged in order to eliminate the soapstock, and the oil is washed with generous amount of water to further remove traces of soapstock. For continuous processes, a series of centrifuges are used to separate neutral oil from soapstock, after which the refined oil is passed through a vacuum dryer to remove residual moisture.

A modification of the continuous alkaline deacidification process is the so called "miscella refining", in which crude oil, dissolved in a solvent (usually hexane), is treated with alkaline solution, then thoroughly mixed, and subsequently centrifuged to separate soapstock and refined miscella (oil is still dissolved in solvent). The alkaline concentration ranges from 4% to 15% depending on the amount of free acid and the other impurities in the crude oil. Miscella refining requires very intensive plant management and high capital investment since most of the machinery must be explosion-proof, and the processes are performed at greater than ambient temperatures.

Regardless of the type of alkaline refining, the process is well established, however, there are many problems associated with it. Treating a triglyceride oil with sodium hydroxide at moderately high temperature would result in some degree of saponification, resulting in a loss of neutral oil. There may also be an emulsion problem during water treatment which often necessitates the use of emulsifying agents. In the case of miscella refining, there can be fouling of the distillation system by residual soapstock, and high labor cost and capital investment. The current processes result in appreciable loss (>5%) of neutral oil, which increases the operating cost.

Consequently, there is a need to develop alternative methods for deacidification of crude vegetable oils. To a limited extent, physical refining has been used for deacidification. In such a process, the oil is treated with steam at elevated temperature in order to steam distil the free fatty acids. However, steam distillation is less efficient than alkaline refining. Moreover, the physical refining process may not be applicable to most oils, due to the varying affinities of different molecules for co-distillation with water.

Recently, many other deacidification processes have been reported, some of which include: biological refining, in which bacteria species are allowed to feed on the FFA; fractionation using furfural as a polar solvent to selectively remove the free acids. Thus, there are continuing research programs aimed at developing efficient, and yet practical modes of solving the deacidification problem facing the vegetable oil industry.

SUMMARY OF THE INVENTION

The present invention comprises a chromatographic process for deacidification of vegetable oils at ambient temperature. Vegetable oil, dissolved in a solvent, e.g., isopropyl alcohol or hexane, is passed through a column of activated alumina (aluminium oxide) at room temperature. The resulting eluent is then stripped to afford a deacidified oil (<0.15% FFA). The ratio of oil to alumina depended on the level of FFA in the original oil. According to the present invention, spent alumina can be reactivated by washing with dilute solution of sodium hydroxide and water, then drying to remove moisture. The process of the present invention has several advantages over current methods of deacidifying vegetable oils, including the minimization of the loss of neutral oil (there is no contact between the oil and sodium hydroxide), the elimination of the emulsion problem since (there is no contact between oil and water), the significantly higher recovery of oil (>97%) yield than current refining processes and the use of rubbing alcohol as a solvent. Additional advantages and cost savings result from the removal of some of the color pigments by the activated alumina, reactivation of the spent alumina with dilute solutions of sodium hydroxide, a reduction in the number of human operators and the easy retrofit of operations currently using miscella refining or solvent extraction.

DETAILED DESCRIPTION OF THE INVENTION

The process of the present invention utilizes a chromatographic column, activated alumina, various filter media and rubbing alcohol or hexane. The process of the present invention was developed experimentally from the deacidification of three distinctly different types of vegetable oils - vernonia oil, a naturally epoxidized seed oil that is being investigated as an industrial feedstock, lesquerella oil, which contains hydroxy fatty acids, and is being investigated as a replacement for castor oil and sunflower oil, an edible oil containing the usual linoleic and oleic acids as major components. The present invention can be more fully understood from the experimental regimen and analysis of the experimental results.

Chromatographic Deacidification

A cylindrical column (4.2 cm wide) with a stopcock opening at the bottom is packed from the bottom successively with glasswool (2.0 cm high), sand (2.0 cm high), activated alumina (ca 50g basic or neutral), sand (2.0 cm high). The height of the activated alumina packing, e.g., ca 4.7 cm high when 50 g. of alumina is used, varied depending on the acid content of the oil to be deacidified. The packed column (containing ca. 50 g basic or neutral alumina) is saturated with 80 mL isopropyl alcohol (IPA), which is used as eluting solvent. Then 50 g of vegetable oil is dissolved in 100 mL of IPA and transferred onto the column, where the eluent is collected over a 70-min period. The column is then rinsed with 100 mL portion of IPA followed by 300 mL of hot water (ca. 85° C.) wash. The IPA rinse and the first 40 mL portion from the hot water wash were added to the oil-IPA eluent, stripping the solvent under vacuum to afford 47 g (97% recovery based on neutral oil minus FFA lost) of deacidified oil. The rest of the hot-water wash was discarded. Except for when dark oils are deacidified, e.g., crude vernonia and lesquerella oils, the packed column was reconstituted with 80 mL of IPA after which the process was repeated twice as described above. After three runs, i.e., two column reconstitutions as described above, the alumina was removed and reactivated as described below. In the case of crude vernonia and lesquerella oils, the alumina was reactivated after each run (i.e., after each hot water wash).

Reactivation of alumina

Spent alumina (after the hot water wash) is transferred into a round-bottom flask, to which 200 mL of 1M NaOH (or 1M KOH) solution is added and thoroughly mixed for 30 minutes at room temperature. After the mixture settles, the supernatant is carefully decanted. After this process is repeated with another 200 mL portion of the 1M NaOH (or 1M KOH) solution, the alumina is washed with three 250-mL portions of water and subsequently drying at 60° C. for about 5.5 hours to give 48 g (96% recovery) of reactivated alumina. Because of the colored pigments and other matter in crude vernonia oil and lesquerella oil, when such oils are deacidified, reactivation of the spent alumina is carried out as described above except that the mixing step takes place in a hot water-bath (ca. 85° C.).

Experimental Results

The first experimental trial involved four successive deacidifications of crude vernonia oil with activated neutral alumina. The oil:alumina weight-ratio was 1:1 and after each deacidification, the column was flushed with hot water (85° C.), then conditioned with isopropyl alcohol. The results, shown in Table 1.1, indicate that on the initial pass through the column, some oil primes the column and is not recovered. Additionally, Table 1.1 indicates that the column is not refreshed by flushing with hot water and conditioning with isopropyl alcohol - the sharp increase in residual acid remaining in the recovered oil evidences significant fouling of the column.

TABLE 1.1

CHROMATOGRAPHIC DEACIDIFICATION OF CRUDE VERNONIA OIL**

| Run # | Wt. of VO (g) Before | Wt. of VO (g) After | % Oil Recovery* | Acid Value Before | Acid Value After | % FFA Before | % FFA After | Wt. of LN (g) |
|---|---|---|---|---|---|---|---|---|
| 1 | 50.03 | 46.01 | 94.9 | 6.10 | 0.24 | 3.23 | 0.13 | 50.35 |
| 2 | 50.05 | 46.75 | 96.2 | 6.10 | 0.72 | 3.23 | 0.38 | 50.35 |
| 3 | 50.05 | 47.32 | 97.0 | 6.10 | 1.42 | 3.23 | 0.75 | 50.35 |
| 4 | 50.06 | 46.97 | 96.1 | 6.10 | 1.69 | 3.23 | 0.89 | 50.35 |

*Calculations were based on initial oil minus amount of FFA lost.
**For each run, the oil was dissolved in 100 mL isopropyl alcohol.

To determine whether the fouling of the column could be controlled, six successive deacidifications of crude vernonia oil were undertaken. In this series of experiments, active neutral alumina was used and the oil:alumina ratio was maintained at 1:1. However, between each of runs 1 to 5, the alumina was removed from the column and reactivated at room temperature with a dilute solution of sodium hydroxide.

As shown in Table 1.2, reactivation of the alumina allowed for four successive deacidifications in which the FFA was less than 0.5%. After the fifth run, where the FFA was 0.99%, the alumina was reactivated with a hot (85–90° C.) dilute solution of sodium hydroxide. After the hot reactivation of the alumina, the FFA following deacidification was 0.12%.

TABLE 1.2

CHROMATOGRAPHIC DEACIDIFICATION OF CRUDE VERNONIA OIL**

| Run # | Wt. of VO (g) Before | Wt. of VO (g) After | % Oil Recovery* | Acid Value Before | Acid Value After | % FFA Before | % FFA After | Wt. of LN (g) |
|---|---|---|---|---|---|---|---|---|
| 1 | 55.02 | 49.48 | 92.9 | 6.45 | 0.46 | 3.40 | 0.24 | 55.25 |
| 2 | 53.19 | 50.56 | 98.2 | 6.45 | 0.46 | 3.40 | 0.24 | 53.45 |
| 3 | 48.18 | 46.16 | 98.9 | 6.45 | 0.47 | 3.40 | 0.25 | 48.23 |
| 4 | 45.26 | 43.52 | 99.3 | 6.45 | 0.48 | 3.40 | 0.25 | 45.14 |
| 5 | 45.10 | 42.48 | 96.5 | 6.45 | 1.88 | 3.40 | 0.99 | 44.50 |
| 6 | 50.12 | 47.57 | 98.1 | 6.45 | 0.22 | 3.40 | 0.12 | 51.20 |

*Calculations were based on initial oil minus amount of FFA lost.
**For each run, the oil was dissolved in 100 mL isopropyl alcohol.

From these results, when compared to the results of Table 1.1, it is apparent that hot water and solvent do not reactivate neutral alumina to the same extent as hot sodium hydroxide wash.

Since vernonia oil is a dark oil containing significant pigments and chlorophyll, four successive deacidifications of bleached vernonia oil with activated neutral alumina were undertaken. In these deacidifications, between runs the column was flushed with 300 ml of hot water (85° C.) and conditioned with isopropyl alcohol. Because bleaching reduced the amount of acid in the oil, the oil:alumina ratio was adjusted to 2:1.

The results of this set of deacidifications are shown in Table 2.1. With bleached vernonia oil, fouling the column did not occur until the fourth run, even though the column was not reactivated with sodium hydroxide after each run. Also, the percentage of oil recovered after the first run was not less than the percentage recovered from other runs. Apparently, less oil was lost in priming the column.

TABLE 2.1

CHROMATOGRAPHIC DEACIDIFICATION OF BLEACHED VERNONIA OIL**

| Run | Wt. of VO (g) | | % Oil | Acid Value | | % FFA | | Wt. of |
|---|---|---|---|---|---|---|---|---|
| # | Before | After | Recovery* | Before | After | Before | After | LN (g) |
| 1 | 60.23 | 58.96 | 99.4 | 2.96 | 0.14 | 1.56 | 0.07 | 30.46 |
| 2 | 60.04 | 58.26 | 98.5 | 2.96 | 0.24 | 1.56 | 0.12 | 30.46 |
| 3 | 60.05 | 58.54 | 98.6 | 2.96 | 0.90 | 1.56 | 0.48 | 30.46 |
| 4 | 60.13 | 59.46 | 99.7 | 2.96 | 1.33 | 1.56 | 0.70 | 30.46 |

*Calculations were based on initial oil minus amount of FFA lost.
**For each run, the oil was dissolved in 120 mL isopropyl alcohol.

To demonstrate that a single run using oil:alumina weight ratio of 6:1 would be less effective than three separate runs, each with a ratio of 2:1, a single deacidification of bleached vernonia oil was undertaken where the oil:alumina ratio was 6:1. As shown in Table 2.2, the FFA after deacidification was substantially greater than when the oil:alumina ratio was maintained at 2:1.

TABLE 2.2

CHROMATOGRAPHIC DEACIDIFICATION OF BLEACHED VERNONIA OIL**

| | Wt. of VO (g) | | % Oil | Acid Value | | % FFA | | Wt. of LN |
|---|---|---|---|---|---|---|---|---|
| Run | Before | After | Recovery* | Before | After | Before | After | (g) |
| 1 | 180.07 | 177.29 | 99.5 | 2.96 | 0.94 | 1.56 | 0.50 | 30.16 |

*Calculations were based on initial oil minus amount of FFA lost.
**The oil was dissolved in 360 mL isopropyl alcohol.

The effectiveness of the deacidification process for a food oil was determined through experiments with sunflower. In an initial series of experiments, the oil:activated neutral alumina ratio was 2:1. In these deacidifications, between the runs the column was flushed with 300 ml of hot water (85° C.) and conditioned with isopropyl alcohol. As shown in Table 3.1, under these conditions, the FFA after the fifth run was still less than 0.5%. In fact, after the fourth run, the FFA was only 0.26%.

TABLE 3.1

CHROMATOGRAPHIC DEACIDIFICATION OF SUNFLOWER OIL**

| Run | Wt. of SFO (g) | | % Oil | Acid Value | | % FFA | | Wt. of LN |
|---|---|---|---|---|---|---|---|---|
| # | Before | After | Recovery* | Before | After | Before | After | (g) |
| 1 | 60.36 | 58.95 | 98.8 | 2.39 | 0.23 | 1.26 | 0.12 | 30.34 |
| 2 | 60.18 | 59.27 | 99.6 | 2.39 | 0.24 | 1.26 | 0.12 | 30.34 |
| 3 | 60.01 | 59.02 | 99.4 | 2.39 | 0.45 | 1.26 | 0.22 | 30.34 |
| 4 | 61.76 | 60.44 | 98.9 | 2.39 | 0.51 | 1.26 | 0.26 | 30.34 |
| 5 | 60.13 | 59.47 | 99.7 | 2.39 | 0.89 | 1.26 | 0.47 | 30.34 |

*Calculations were based on initial oil minus amount of FFA lost.
**For each run, the oil was dissolved in 120 mL isopropyl alcohol.

To determine the efficacy of the process for reactivating the alumina, a series of deacidifications of sunflower oil using reactivated neutral alumina were undertaken. Reactivation of the alumina was done in accordance with the process described above - i.e., thorough washing with hot water, followed by mixing with successive 1M hydroxide solutions and drying at 60° C. As shown in Table 3.2, reactivated alumina allows for successive deacidifications without substantial fouling, although the number of successive, successful deacidifications is somewhat reduced.

TABLE 3.2

CHROMATOGRAPHIC DEACIDIFICATION OF SUNFLOWER OIL**

| | Wt. of SFO (g) | | % Oil | Acid Value | | % FFA | | Wt. of LN |
|---|---|---|---|---|---|---|---|---|
| Run # | Before | After | Recovery* | Before | After | Before | After | (g)+ |
| 1 | 58.54 | 57.27 | 99.0 | 2.39 | 0.14 | 1.26 | 0.07 | 28.83 |
| 2 | 58.24 | 56.98 | 98.9 | 2.39 | 0.37 | 1.26 | 0.19 | 28.83 |
| 3 | 58.37 | 56.82 | 98.3 | 2.39 | 0.45 | 1.26 | 0.27 | 28.83 |
| 4 | 58.28 | 56.43 | 97.3 | 2.39 | 1.55 | 1.26 | 0.78 | 28.83 |

*Calculations were based on initial oil minus amount of FFA lost.
+ = Reactivated neutral alumina.
**For each run, the oil was dissolved in 120 mL isopropyl alcohol.

As with vernonia oil, the oil:reactivated neutral alumina ratio is important. As this ratio approaches 8:1 the effectiveness of the deacidification process decreases. As shown in Table 3.3, after one deacidification when such an oil:alumina ratio is used, the FFA is 0.48%.

TABLE 3.3

| CHROMATOGRAPHIC DEACIDIFICATION OF SUNFLOWER OIL** | | | | | | | | |
|---|---|---|---|---|---|---|---|---|
| | Wt. of SFO (g) | | % Oil | Acid Value | | % FFA | | Wt. of LN |
| Run | Before | After | Recovery* | Before | After | Before | After | (g) |
| 1 | 160.08 | 156.94 | 98.8 | 2.39 | 0.96 | 1.26 | 0.48 | 20.15 |

*Calculations were based on initial oil minus amount of FFA lost.
**The oil was dissolved in 320 mL isopropyl alcohol.

In another series of experiments, crude lesquerella oil is deacidified by activated neutral alumina. As with crude vernonia oil, the chromatographic column failed significantly after only a couple of runs. As shown in Table 4, more than half the acid present in the oil was not removed by the third deacidification.

TABLE 4

| CHROMATOGRAPHIC DEACIDIFICATION OF CRUDE LESQUERELLA OIL** | | | | | | | | |
|---|---|---|---|---|---|---|---|---|
| | Wt. of LO (g) | | % Oil | Acid Value | | % FFA | | Wt. of LN |
| Run # | Before | After | Recovery* | Before | After | Before | After | (g) |
| 1 | 10.03 | 9.76 | 99.2 | 3.45 | 0.20 | 1.97 | 0.11 | 5.09 |
| 2 | 10.00 | 9.78 | 99.5 | 3.45 | 0.49 | 1.97 | 0.28 | 5.09 |
| 3 | 10.05 | 9.81 | 98.4 | 3.45 | 1.97 | 1.97 | 1.14 | 5.09 |

*Calculations were based on initial oil minus amount of FFA lost.
**For each run, the oil was dissolved in 20 mL isopropyl alcohol.

To determine the effectiveness of the deacidification process on processed lesquerella oil, four runs were undertaken where bleached lesquerella oil was deacidified with activated neutral alumina. Because of the reduced amount of acid present in the raw oil, the oil:alumina ratio was maintained at 2:1. Table 5.1 shows that as with vernonia oil, more successive, successful deacidifications prior to column fouling were possible with bleached oil versus crude oil.

TABLE 5.1

| CHROMATOGRAPHIC DEACIDIFICATION OF BLEACHED LESQUERELLA OIL** | | | | | | | | |
|---|---|---|---|---|---|---|---|---|
| | Wt. of LO (g) | | % Oil | Acid Value | | % FFA | | Wt. of LN |
| Run # | Before | After | Recovery* | Before | After | Before | After | (g) |
| 1 | 50.06 | 48.95 | 99.2 | 2.96 | 0.14 | 1.48 | 0.08 | 25.26 |
| 2 | 50.06 | 49.03 | 99.3 | 2.96 | 0.24 | 1.48 | 0.14 | 25.26 |
| 3 | 50.04 | 49.09 | 99.3 | 2.96 | 0.47 | 1.48 | 0.28 | 25.26 |
| 4 | 50.08 | 49.51 | 99.8 | 2.96 | 0.97 | 1.48 | 0.56 | 25.26 |

*Calculations were based on initial oil minus amount of FFA lost.
**For each run, the oil was dissolved in 100 mL isopropyl alcohol.

With bleached lesquerella oil, the efficacy of using reactivated neutral alumina was checked. Again, using an oil:alumina ratio of 2:1, successive deacidifications of the bleached lesquerella oil were undertaken. As with the sunflower oil, reactivated alumina permitted some successive, successful deacidifications. However, consistent with Table 3.2, Table 5.2 shows that the number of such successive, successful deacidifications prior to fouling of the column was reduced.

TABLE 5.2

| CHROMATOGRAPHIC DEACIDIFICATION OF BLEACHED LESQUERELLA OIL** | | | | | | | | |
|---|---|---|---|---|---|---|---|---|
| | Wt. of LO (g) | | % Oil | Acid Value | | % FFA | | Wt. of LN+ |
| Run # | Before | After | Recovery* | Before | After | Before | After | (g) |
| 1 | 56.08 | 55.24 | 99.9 | 2.96 | 0.10 | 1.48 | 0.05 | 28.35 |
| 2 | 56.14 | 55.25 | 99.8 | 2.96 | 0.24 | 1.48 | 0.12 | 28.35 |
| 3 | 56.07 | 55.43 | 99.9 | 2.96 | 0.94 | 1.48 | 0.47 | 28.35 |
| 4 | 56.26 | 55.84 | 99.9 | 2.96 | 1.63 | 1.48 | 0.81 | 28.35 |

*Calculations were based on initial oil minus amount of FFA lost.
+ = Reactivated neutral alumina.
**For each run, the oil was dissolved in 120 mL isopropyl alcohol.

While many of the experiments were conducted with neutral activated alumina, the process of the present invention can be practiced with activated acidic alumina. Table 6 shows the results of deacidification of bleached vernonia, where the oil:alumina ratio was 2:1. Comparing Table 2.1 to 2.6, neutral activated alumina appears to be only slightly preferred - after a third run, the FFA using activated neutral alumina was 0.48%, while using activated acidic activated alumina, the FFA was 0.64%. Interestingly, the room temperature reactivation with the dilute solution of sodium hydroxide appears to completely reactivate the formerly acidic alumina.

TABLE 6

| CHROMATOGRAPHIC DEACIDIFICATION OF BLEACHED VERNONIA OIL*** | | | | | | | | |
|---|---|---|---|---|---|---|---|---|
| | Wt. of VO (g) | | % Oil | Acid Value | | % FFA | | Wt. of LA |
| Run # | Before | After | Recovery* | Before | After | Before | After | (g) |
| 1 | 40.06 | 37.7 | 95.5 | 2.99 | 0.19 | 1.58 | 0.10 | 20.05 |
| 2 | 40.09 | 39.17 | 99.0 | 2.99 | 0.49 | 1.58 | 0.26 | 20.05 |
| 3 | 40.03 | 39.54 | 99.7 | 2.99 | 1.22 | 1.58 | 0.64 | 20.05 |
| 4 | 40.23 | 39.68 | 99.2 | 2.99 | 1.90 | 1.58 | 1.00 | 20.05 |
| 5** | 30.10 | 29.02 | 97.9 | 2.99 | 0.19 | 1.58 | 0.10 | 15.09 |

*Calculations were based on initial oil minus amount of FFA lost.
LA = Acidic alumina.
**Acidic alumina was removed after Run-4, then reactivated at room-temperature with a dilute solution of sodium hydroxide.
***For each of the first four runs, the oil was dissolved in 80 mL isopropyl alcohol, while the oil in the fifth run was dissolved in 60 mL isopropyl alcohol.

A comparison between the data of the deacidification in crude and bleached vernonia oil and crude and bleached lesquerella oil can probably be explained by the colored pigments and other materials in the two oils. For example, as shown in Table 7, there is a significant reduction in the coloration of vernonia oil after deacidification together with an 80% decrease in chlorophyll-A and a similar decrease in the amount of beta carotene. However, as shown in Table 8, there is no significant decrease in the coloration, the amount of chlorophyll or the amount of beta carotene uncovered between the crude and the deacidified lesquerella oil.

TABLE 7

| COLORIMETRIC ANALYSIS OF CRUDE AND CHROMATOGRAPHED VERNONIA OILS | | |
|---|---|---|
| | CRUDE OIL | CHROMATOGRAPHED OIL |
| Lovibond | 3.8 R; 51.9 Y; 3.2 B; 0.0 N | 1.4 R; 9.5 Y; 0.1 B; 0.0 N |
| Chlorophyll-A | 26.68 ppm | 6.12 ppm |
| Beta Carotene % | 6184506.0 ppm | 2095996.5 ppm |

TABLE 8

| COLORIMETRIC ANALYSIS OF CRUDE AND CHROMATOGRAPHED LESQUERELLA OILS | | |
|---|---|---|
| | CRUDE OIL | CHROMATOGRAPHED OIL |
| Lovibond | 10.0 R; 69.0 Y; 0.0 B; 1.0 N | 9.9 R; 69.0 Y; 0.0 B; 1.9 N |
| Chlorophyll-A | 4.95 ppm | 4.50 ppm |
| Beta Carotene % | 13649277 ppm | 14415524 ppm |

For each of the experimental vegetable oil (crude or bleached), the first column chromatographic run afforded a deacidified oil with a residual FFA content of <0.15% (Tables 2–6). Column efficiency was dependent on the level of FFA in the original oil (Table 2.1), hence it was necessary to maintain a workable ratio of oil/alumina. From the deacidification of vegetable oils shown in Table 1.1–6, workable oil to alumina ratio based on activated neutral alumina, required to provide for acceptable deacidifications is provided in Table 9.

TABLE 9

| A WORKABLE RATIO (wt/wt) OF OIL TO ALUMINA FOR THE CHROMATOGRAPHIC DEACIDIFICATION OF VEGETABLE OILS. | |
|---|---|
| ACID VALUE | RATIO (OIL/ALUMINA) |
| 0.0–3.0 | 2:1 |
| 3.0–6.0 | 1:1 |
| 6.0–9.0 | 2:3 |

TABLE 9-continued

| A WORKABLE RATIO (wt/wt) OF OIL TO ALUMINA FOR THE CHROMATOGRAPHIC DEACIDIFICATION OF VEGETABLE OILS. | |
|---|---|
| ACID VALUE | RATIO (OIL/ALUMINA) |
| 9.0–12.0 | 1:2 |

The average % recovery of the oil, based on the neutral oil minus amount of FFA lost, was 98.2 (±1.7). However, when the neat oil (oil without solvent) was passed through the column, there was only about 50% oil recovery prior to rinsing the column with solvent, in which case most of the oil was recovered. Therefore, an optimum condition for maximum oil recovery appear to be to dissolve the oil in the solvent (rubbing alcohol or hexane) prior to passing through the chromatographic column.

In the case of light-colored oils (such as sunflower), and bleached vernonia and lesquerella oils, a second run (after flushing the column with hot water) was found to reduce the FFA content to less than 0.2%. Depending on the standards set for the maximum amount of FFA permissible in an oil, the column could similarly be used for a third run before reactivation of the alumina material, otherwise reactivation should be carried out after the second run to keep the FFA level down to 0.2%. The average residual %FFA of the first three column chromatographic runs of bleached and light-colored oils was ca. 0.20. However, when the ratio of oil to alumina was tripled prior to a single chromatographic run, the %FFA of the resulting oil was greater than twice the average %FFA obtained from three separate runs, thus suggesting that flushing of the column with hot water (85° C.), between runs, is absolutely necessary in order to maintain column efficiency.

With light-colored or bleached oils, reactivation of the spent alumina was carried out at room temperature. Nevertheless, subsequent reactivation of the stationary phase at 85–90° C. was necessary after two room-temperature reactivation. Because of the heavy pigmentation in colored oils such as crude vernonia and lesquerella oils, reactivation of the alumina at 85–90° C. was required after each run in order to maintain the efficiency of the stationary phase (Tables 2–6).

Analysis of the oil before and after column chromatographic runs by GC/MS and Iodine-value determination indicated that the composition of the triglyceride was unaffected by the three different types of activated alumina used in these deacidification experiments. Similarly, the weight per epoxy (WPE) determinations of the oil before and after the runs for epoxidized oils (vernonia oil) showed that the integrity of the epoxy functionality was conserved with all types of activated alumina.

Colorimetric analysis of the oils, especially in the case of crude vernonia oil, indicated that most of the color pigments were removed during deacidification (Table 7), which should make subsequent processing methods such as bleaching more cost effective. The relatively lower percent recovery of crude vernonia oil could be attributed to the appreciable amount of chlorophyll and other color material that could entrap some neutral oil.

It should be noted that since the spent alumina is reactivated with dilute alkaline solutions, then basic alumina should be a logical choice for this new deacidification process, provided that the basic alumina is less expensive than other grades of alumina. Furthermore, the rubbing alcohol can be replaced by hexane and the oils are similarly deacidified.

Therefore, we intend only to be limited by the following claims.

We claim:

1. A process for the deacidification of a vegetable oil in which the major acid of the vegetable oil is from the group comprised of epoxy fatty acids, hydroxy fatty acids, linoleic acid and oleic acid, said process comprising the passing of the vegetable oil through a column of activated alumina while the vegetable oil is dissolved in a solvent.

2. The process of claim 1, further comprising reactivation of spent alumina by:

placing said alumina in a basic solution;

be mixing the resulting mixture; and decanting the supernatant of the resulting mixture.

3. The process of claim 2, wherein the basic solution comprises a base selected from sodium hydroxide and potassium hydroxide.

4. A process for the deacidification of a vegetable oil in which the major acid of the vegetable oil is from the group comprised of epoxy fatty acids, hydroxy fatty acids, linoleic acid and oleic acid, said process comprising the passing of the vegetable oil through a column of activated alumina, wherein the vegetable oil is dissolved in a solvent from the group consisting of 2-propanol and hexane before passing through the column of activated alumina.

5. The process of claim 4, wherein the vegetable oil is sunflower oil and the solvent is rubbing alcohol.

6. The process of claim 4, wherein the vegetable oil is sunflower oil and the solvent is hexane.

7. The process of claim 4, wherein the vegetable oil is vernonia oil and the solvent is rubbing alcohol.

8. The process of claim 4, wherein the vegetable oil is vernonia oil and the solvent is hexane.

9. The process of claim 4, wherein the vegetable oil is lesquerella oil and the solvent is rubbing alcohol.

10. The process of claim 4, wherein the vegetable oil is lesquerella oil and the solvent is hexane.

11. The process of claim 4, wherein the major acid of the vegetable oil is an epoxy fatty acid.

12. The process of claim 4, wherein the major acid of the vegetable oil is a hydroxy fatty acid.

13. The process of claim 4, wherein the major acid of the vegetable oil is linoleic acid.

14. The process of claim , wherein the major acid of the vegetable oil is oleic acid.

15. The process of one of claims 4–14 which further comprises reactivation of spent alumina by:

placing said alumina in a basic solution;

be mixing the resulting mixture; and decanting the supernatant of the resulting mixture.

16. The process of claim 15, wherein the basic solution is sodium hydroxide.

17. The process of claim 15, wherein the basic solution is potassium hydroxide.

* * * * *